US007381115B2

(12) United States Patent
Heesemann

(10) Patent No.: US 7,381,115 B2
(45) Date of Patent: Jun. 3, 2008

(54) PROCESSING MACHINE AND FLOATING-BEARING ARRANGEMENT FOR IT

(76) Inventor: Jürgen Heesemann, Bessinger Strasse 27, D-32547 Bad Oeynhausen (DE)

( * ) Notice: Subject to any disclaimer, the term of this patent is extended or adjusted under 35 U.S.C. 154(b) by 85 days.

(21) Appl. No.: 10/724,079

(22) Filed: Dec. 1, 2003

(65) Prior Publication Data

US 2004/0171335 A1 Sep. 2, 2004

(30) Foreign Application Priority Data

Nov. 29, 2002 (DE) ..... 102 56 124

(51) Int. Cl.
*B24B 7/00* (2006.01)

(52) U.S. Cl. ..... 451/162

(58) Field of Classification Search ..... 451/162, 451/163, 177, 119–121; 384/49–52, 58
See application file for complete search history.

(56) References Cited

U.S. PATENT DOCUMENTS 3,822,511 A * 7/1974 Hoglund ..... 451/239
3,947,079 A * 3/1976 Anderson ..... 384/603
4,483,216 A * 11/1984 Takahashi et al. ..... 475/195
5,138,862 A * 8/1992 Chasteen et al. ..... 72/347
6,863,598 B2 * 3/2005 Ling et al. ..... 451/177
6,910,955 B2 * 6/2005 Wang et al. ..... 451/67

FOREIGN PATENT DOCUMENTS

EP 0 543 947 B1 2/1999

* cited by examiner

*Primary Examiner*—Hadi Shakeri
(74) *Attorney, Agent, or Firm*—Foley & Lardner LLP

(57) ABSTRACT

A processing machine (1) has a machine frame (2) and a processing element (3) arranged so as to be movable relative thereto via a drive shaft (5). The drive shaft (5) is coupled with the machine frame (2) and the processing element (3) by means of a floating-bearing arrangement (13). The floating-bearing arrangement (13) has at least two rolling-contact bearings (16, 19, 22, 24), with a first rolling-contact bearing (19, 24), coupled with the drive shaft (5), and a second rolling-contact bearing (16, 22), arranged on the machine frame (2), and a common connecting bearing shell (15, 25, 26). The connecting bearing shell (15, 25, 26) supports the rolling-contact bodies of the first and second rolling-contact bearings (16, 19, 22, 24) and is driven.

6 Claims, 4 Drawing Sheets

PROCESSING MACHINE AND FLOATING-BEARING ARRANGEMENT FOR IT

CROSS-REFERENCE TO RELATED PATENT APPLICATIONS

The right of priority under 35 U.S.C. § 119 (a) is claimed for Federal Republic of Germany Patent Application 102 56 124.9, filed Nov. 29, 2002, the specification, drawings, claims and abstract of which are incorporated herein by reference in their entirety.

BACKGROUND OF THE INVENTION

The invention relates to a processing machine having a machine frame and a processing element arranged so as to be movable relative thereto via at least one drive shaft. The drive shaft is coupled to the machine frame and the processing element by means of a floating-bearing arrangement.

The invention also relates to a floating-bearing arrangement having a first rolling-contact bearing and a second rolling-contact bearing, in particular for use in such a processing machine, and to a method of mounting a rotatably driven shaft with such a floating-bearing arrangement.

In sanding machines, for example, a pressure element which can be driven in an oscillating manner and is intended for pressing abrasive onto a workpiece is supported on a machine frame by means of one or more drive shafts. The pressure element and the machine frame extend in a longitudinal direction at right angles to the delivery direction of the workpiece to be processed. The processing element, i.e., the pressure element, and the machine frame expand to a different degree due to the heating which occurs during the processing. This effect is partly intensified owing to the fact that, in sanding machines, for example, the pressure element, is made of aluminum in order to save weight, and the machine frame is made of steel. Such a sanding machine is disclosed, for example, by EP 0 543 947 B1.

If the processing element is rotatably attached to the machine frame by means of linear rolling-contact bearings, on account of the thermally induced linear expansions of the machine frame and of the processing element, relatively large loads of the linear rolling-contact bearings can occur in the longitudinal direction of the processing element and of the machine frame.

SUMMARY OF THE INVENTION

One object of the invention is therefore to provide an improved processing machine and a floating bearing for it.

Another object of the invention is to provide such a machine and bearing in which processing machine loads of the floating bearing are absorbed to prevent destruction of the floating bearing.

In accordance with one aspect of the invention, there has been provided a processing machine, comprising: a machine frame; a processing element arranged so as to be movable relative to the machine frame; at least one drive shaft for moving the processing element relative to the machine frame; and a floating-bearing arrangement coupling the at least one drive shaft to the machine frame and the processing element, wherein the floating-bearing arrangement comprises at least two rolling-contact bearings coupled to one another and having a first rolling-contact bearing that is coupled with the drive shaft, and a second rolling-contact bearing that is arranged on the machine frame, and a common connecting bearing shell, wherein the connecting bearing shell supports rolling-contact bodies of the first and second rolling-contact bearings and wherein the bearing arrangement comprises a drive for moving the connecting bearing shell.

In accordance with another aspect of the invention, there has been provided a floating-bearing arrangement, comprising a first rolling-contact bearing and a second rolling-contact bearing, wherein the first and second rolling-contact bearings have a common connecting bearing shell which supports the rolling-contact bodies of the first and second rolling-contact bearings; and a drive device for moving the common connecting bearing shell relative to the rolling-contact bodies.

In accordance with still another aspect of the invention, there has been provided a method for mounting a rotatably driven shaft with a floating-bearing arrangement as defined above, comprising the step of essentially constantly moving the common connecting shell of the first and second rolling-contact bearings.

Further objects, features and advantages of the present invention will become apparent from the detailed description of preferred embodiments that follows, when considered together with the accompanying figures of drawing.

DETAILED DESCRIPTION OF THE PREFERRED EMBODIMENTS

Figure 1:
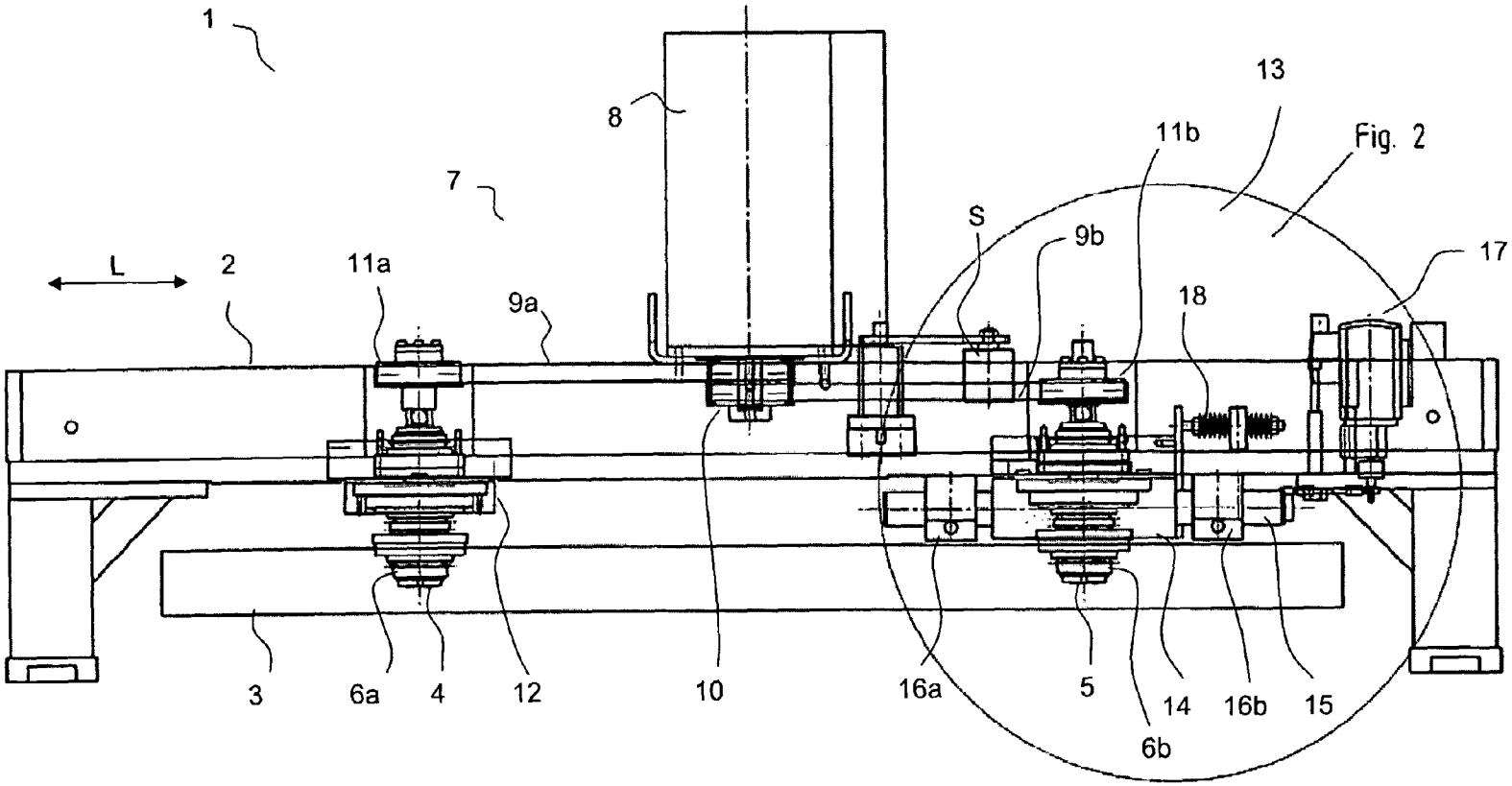
FIG. 1 is a sectional view showing an orbital sander having a machine frame and a pressure element supported by the machine frame via two drive shafts, one drive shaft being mounted with a floating-bearing arrangement according to the invention.

According to the invention, a processing machine of the generic type has a floating-bearing arrangement having at least two rolling-contact bearings coupled to one another and having a first rolling-contact bearing, coupled to the drive shaft, and a second rolling-contact bearing, arranged on the machine frame. The bearing arrangement preferably also includes a common connecting bearing shell supporting the rolling-contact bodies of the first and second rolling-contact bearings that are coupled to one another. The connecting bearing shell is driven such as to be rotatable or movable in a reciprocating manner in such a way that the rolling-contact bodies are kept in motion.

The invention also comprises an improved floating-bearing arrangement wherein first and second rolling-contact bearings have a common connecting bearing shell which supports the rolling-contact bodies of the first and second rolling-contact bearings and is driven such as to be rotatable or movable in a reciprocating manner in such a way that the rolling-contact bodies are kept in motion.

As a result of the common connecting bearing shell and the feature of driving the shell, provision is made for the rolling-contact bodies to be moved continuously and for permanent lubrication to be ensured as a result. In addition, the rolling-contact bodies are constantly loaded at different points, so that flattening of the rolling-contact bodies is prevented.

In this way, premature destruction of the rolling-contact bodies by forces is prevented, particularly in a main expansion direction at right angles to the bearing axis.

The processing machine is preferably a sanding machine having a processing element in the form of an elongated pressure element for applying an abrasive. In this case, the pressure element is supported on the machine frame by preferably two drive shafts. The drive shafts are in this case at a distance from one another in the longitudinal direction of the pressure element. The longitudinal direction of the pressure element also establishes the main expansion direction. At least one of the drive shafts is coupled to the machine frame by means of the floating-bearing arrangement according to the invention. In this way, one of the drive shafts may be mounted in fixed manner in the longitudinal direction and the other drive shaft is preferably mounted in a floating manner in the longitudinal direction, whereby compensation is provided for a linear expansion of the pressure element and/or of the machine frame.

In one advantageous embodiment, the drive shaft is rotatably mounted on a support and on the processing element, with the first rolling-contact bearing being connected to the support and the second rolling-contact bearing being connected to the machine frame. The rolling-contact bearings are designed as linear bearings. A connecting bearing shell, preferably in the form of a connecting spindle, is provided in order to permit a displacement of the support relative to the machine frame in the main expansion direction. The connecting spindle is preferably movable in a reciprocating manner in the main expansion direction or is preferably rotatable in a preferred direction, and it preferably extends through the rolling-contact bearings and couples the latter to one another. In this context, "coupling" means relating the respective elements together in a cooperating relationship. The rolling-contact bodies of the rolling-contact bearings are preferably permanently kept in motion and lubricated on account of the reciprocating movement or rotation of the connecting spindle.

In this case, the support is preferably coupled to the machine frame by means of spring elements acting in the main expansion direction. In this way, in addition to the friction grip in the main expansion direction between the connecting spindle and the rolling-contact bearings, a further non-positive connection is effected between support and machine frame.

Two connecting spindles are preferably provided which extend parallel to one another in the longitudinal direction of the pressure element and which are in each case arranged with a linear bearing on the support, so as to be movable in a reciprocating manner in the longitudinal direction. The connecting spindles are arranged on the machine frame on both sides of the linear bearing, in each case with a linear bearing so as to be movable in a reciprocating manner in the longitudinal direction. In this way, the support is firmly mounted on the machine frame and so as to be movable merely in the main extension direction.

The at least one drive shaft can be designed as an eccentric shaft, so that an oscillating movement of the processing element, for example, of the pressure element of a sanding machine, is produced when the drive shafts are rotationally driven.

To compensate for play in the guides of the rolling-contact bearings with respect to the connecting spindle, it is advantageous if the support is pre-stressed with pressure elements in the axial direction of the drive shafts on the machine frame, so that pressure forces are imposed on the support.

The at least one drive shaft is driven, for example, via a toothed-belt drive, which should also preferably be pre-tensioned with a tensioning device in order to compensate for a certain amount of play.

Accordingly, in a floating-bearing arrangement provided for such a processing machine, it is advantageous if the connecting bearing shell is driven by means of a drive device so as to be movable in a reciprocating manner or rotatable, so that permanent movement and lubrication of the rolling-contact bodies is ensured.

In one embodiment, the rolling-contact bearings may be linear bearings arranged centrally about a common axis. The outer ring of the first rolling-contact bearing is in this case enclosed by the inner ring of the second rolling-contact bearing, with the outer ring together with the inner ring forming the connecting bearing shell. In this case, the axis of the first rolling-contact bearing may also be offset slightly about the axis of the second rolling-contact bearing in order to produce eccentricity of the rotation. By applying rotation, in particular alternating clockwise/counterclockwise rotation, of the connecting bearing shell, any flattening of the rolling-contact bodies due to loads at right angles to the bearing axis can be prevented.

In another preferred embodiment, the rolling-contact bearings are designed as linear bearings and are coupled to one another by means of a connecting spindle, serving as the driven connecting bearing shell, which extends in the bearing axial direction and is movable in a reciprocating manner. In this embodiment, loads of the floating bearing in the extension direction of the connecting spindle are compensated for.

In this embodiment, it is advantageous if in each case a second and third rolling-contact bearing are provided on both sides of the first rolling-contact bearing arranged on the connecting spindle in a sliding manner in the axial direction of the connecting spindle. In this case, the first rolling-contact bearing may be connected to the machine frame, and the second and third rolling-contact bearings may be connected to the support, or vice versa.

It is again advantageous, in the case where at least two connecting spindles are arranged parallel to one another, for the connecting spindles to each support first, second and third rolling-contact bearings. This provides a floating-bearing arrangement with which a support attached to the first rolling-contact bearings can be attached in a tilt-fast way (resisting lateral skewing) to a support that is attached to the machine frame on which the second and third rolling-contact bearings are attached Turning now to the drawings, FIG. 1 shows a processing machine 1 in the embodiment of a sanding machine having a machine frame 2 which extends in the longitudinal direction L and is designed as a steel girder. Arranged below the machine frame 2 is a processing element 3, which forms an aluminum pressure element for abrasive which is pressed onto a workpiece (not shown) to be processed. The processing element is held on the machine frame 2 by means of two eccentric drive shafts 4 and 5. The drive shafts 4 and 5 are arranged at a distance from one another in the longitudinal direction L and are in each case attached to the processing element 3 in a rotatable manner by means of a bearing 6*a*, 6*b*.

The drive shafts 4 and 5 are driven by a toothed-belt drive 7. The toothed-belt drive 7 has a drive motor 8 and in each case a toothed belt 9*a*, 9*b*, which extends from a toothed-belt pulley 10 on the shaft of the drive motor 8 to a toothed-belt pulley 11*a*, 11*b* on the respectively associated drive shaft 4, 5.

In the preferred embodiment illustrated here, the drive shaft 4 shown on the left in FIG. 1 is firmly coupled to the machine frame 2 in a rotatable manner by means of a bearing arrangement 12 forming a fixed bearing.

On the other hand, the drive shaft 5 shown on the right in FIG. 1 is supported by the machine frame 2 with a floating-bearing arrangement 13. It is alternatively possible for both bearing 12 and 13 to be of this floating-bearing type.

The floating-bearing arrangement 13 is displaceable essentially in the longitudinal direction L, which is also the main expansion direction during operation of the processing machine 1. This is because, during the sanding operation for example, the processing element 3 and possibly the machine frame 2 heat up, in the course of which a relative expansion movement occurs between processing element 3 and machine frame 2. In particular on account of the different material and configuration and the different heating, this expansion movement loads the bearing arrangement of the drive shaft 5 in the longitudinal direction L.

By means of a tensioning device S, it is ensured that the toothed belt 9*b* is tensioned during the displaceable mounting of the drive shaft 5 in the longitudinal direction L.

The drive shaft 5 supported in a floating-bearing is rotatably mounted on a support 14. This support 14 is in turn mounted with rolling-contact bodies in a manner so as to be guided in the longitudinal direction L on a connecting spindle 15, which also extends in the longitudinal direction, i.e., the main expansion direction. The support 14 forms the first rolling-contact bearing with the connecting spindle 15. On both sides of support 14, a second and a third rolling-contact bearing 16*a*, 16*b* are in each case preferably provided on the connecting spindle 15. The second and third rolling-contact bearings 16*a*, 16*b* are designed as linear rolling-contact bearings, the outer ring (race) of which is firmly connected to the machine frame 2.

Thus the support 14 with the first rolling-contact bearing integrated in it together with the connecting spindle 15 and the second and third rolling-contact bearings 16*a* and 16*b* form a floating-bearing for the drive shaft 5 which is displaceable in the longitudinal direction L.

The connecting spindle 15 is coupled to a motor 17, for example, via an eccentric shaft or any other mechanism for providing reciprocating movement, in such a way that the connecting spindle 15 performs a reciprocating movement in the longitudinal direction L (hereinafter simply referred to as "reciprocating motor 17"). This ensures permanent movement of the rolling-contact bodies and permanent lubrication of the first, second and third rolling-contact bearings. In this way, loads which act on the floating bearing 13 can be absorbed, and destruction of the floating bearing 13 can be avoided.

In addition, the support 14 is coupled via a spring arrangement 18, so that, in addition to the friction grip by the first, second and third rolling-contact bearings, a further non-positive connection is ensured, whereby forces of the toothed belt 9*b* are absorbed.

Figure 2:
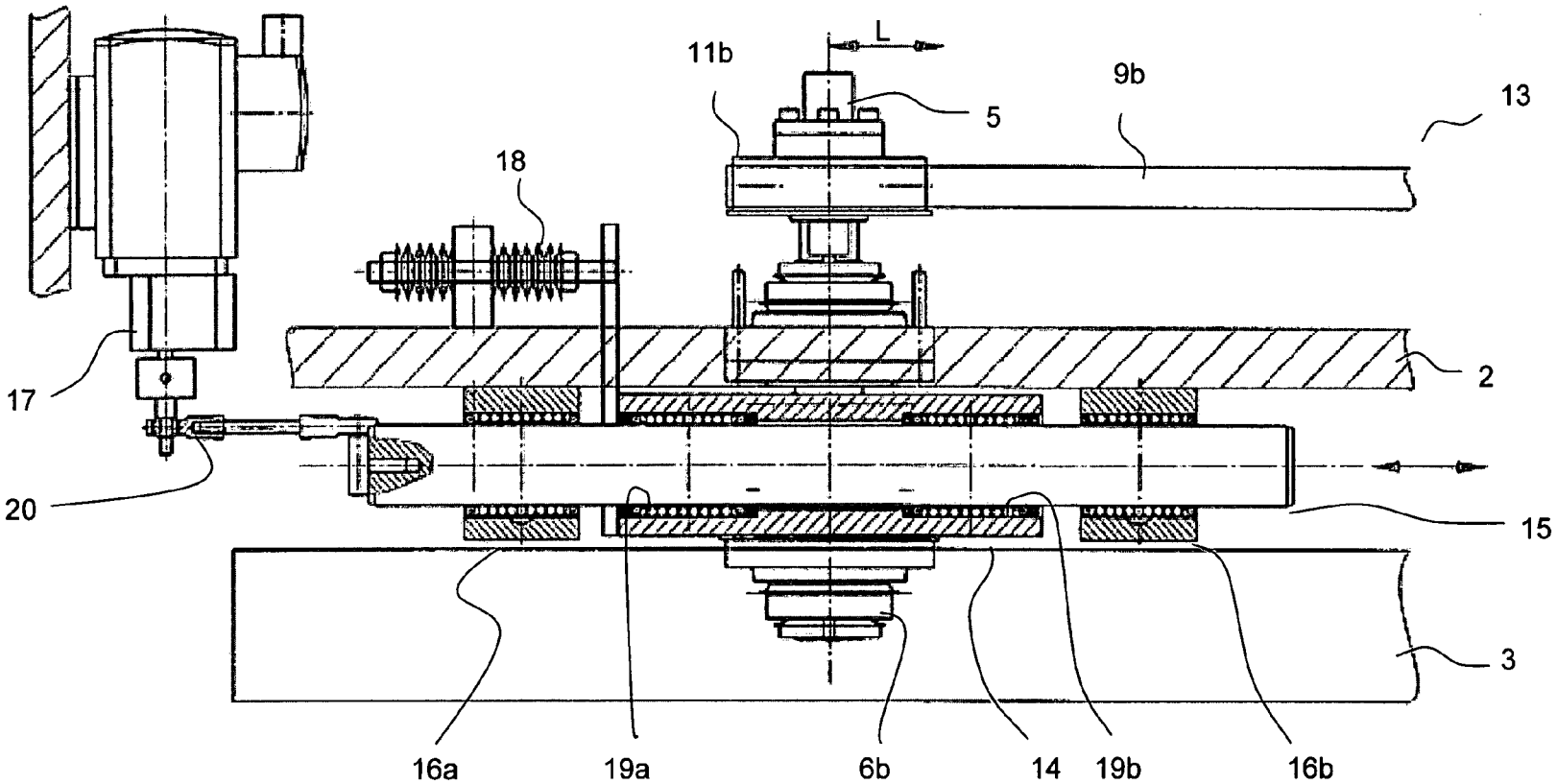
FIG. 2 is a detailed sectional view showing a portion of the processing machine of FIG. 1, with the floating-bearing arrangement according to the invention.

FIG. 2 shows in more detail the structure shown in the circled portion in FIG. 1. In this view, the processing machine 1 is rotated by 180° vis-à-vis. In this case, there is provided on both ends of the cylindrical support 14 a first rolling-contact bearing 19*a*, 19*b* in the form of a linear rolling-contact bearing, wherein the rolling bodies are supported on one side by the connecting spindle 15. On both sides of the support 14, the second and third rolling-contact bearings 16*a*, 16*b* are then arranged on the connecting spindle 15, likewise in the form of a linear rolling-contact bearing.

The connecting spindle 15 forms a connecting bearing shell for the rolling-contact bodies of the first, second and third rolling-contact bearings 19*a*, 19*b*, 16*a*, 16*b*.

The connecting spindle 15 can be moved in a reciprocating manner in the longitudinal direction L by the reciprocating motor 17 during rotation of an eccentric shaft 20, the longitudinal direction L being the main expansion direction of the processing machine 1 or the expansion direction to be compensated.

FIG. 2 also shows the spring element 18, which couples the support 14 to the machine frame 2 in the longitudinal direction L and absorbs tensile forces of the toothed belt 9*b*.

Figure 3:
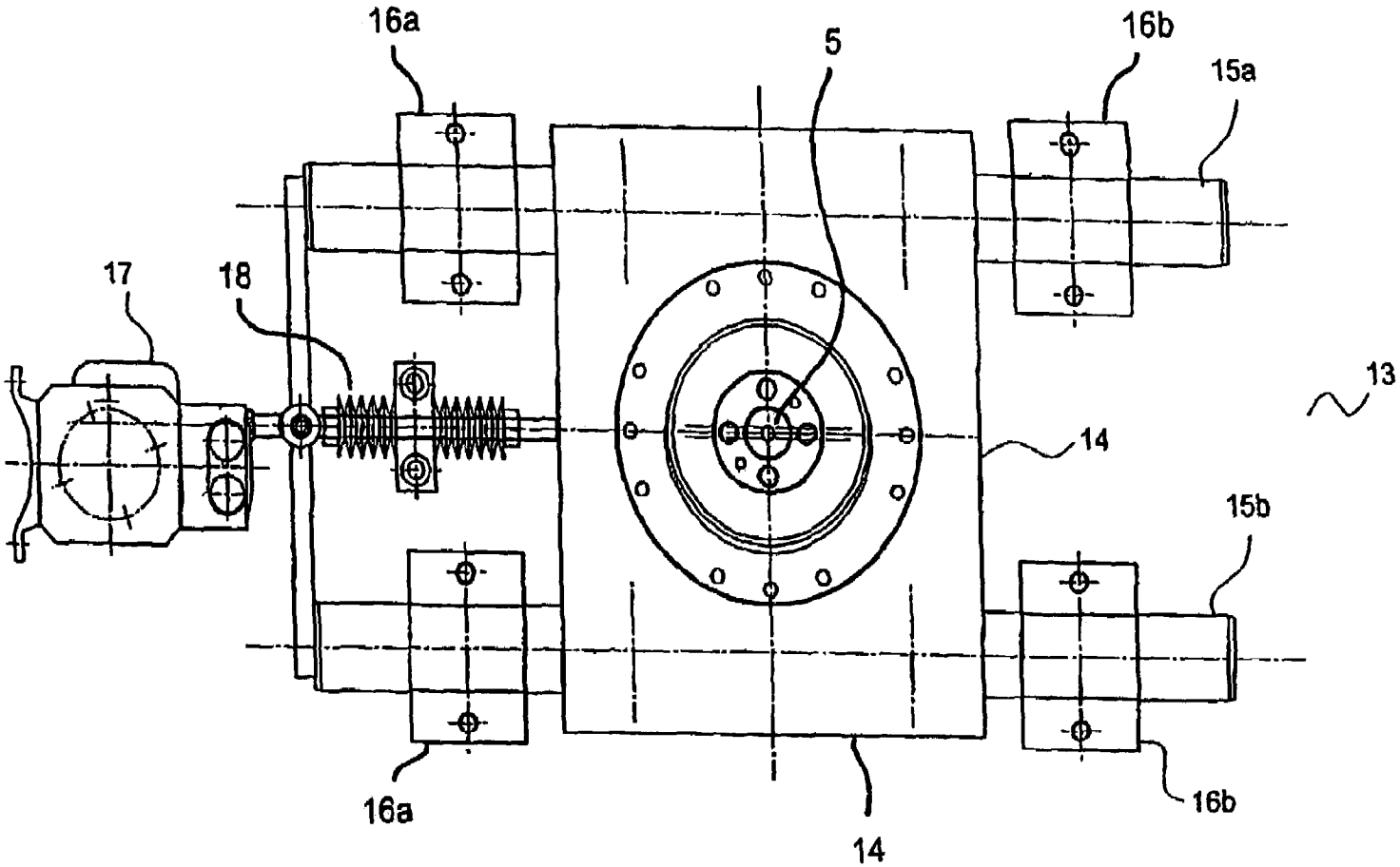
FIG. 3 is a plan view showing the floating-bearing arrangement from FIG. 2.

FIG. 3 shows the bearing arrangement 13 from FIG. 2 in plan view. In this preferred arrangement, two connecting spindles 15*a*, 15*b* are arranged parallel to one another. The connecting spindles 15*a*, 15*b* extend in the longitudinal direction L. In the support 14, a first rolling-contact bearing 19*a*, 19*b* is fitted in each case for the connecting spindles 15*a*, 15*b*, with the rolling-contact bearings in each case radially enclosing the connecting spindle 15*a*, 15*b* with rolling-contact bodies. On both sides of the support 14 the second and third rolling-contact bearings 16*a*, 16*b* are provided on each of the connecting spindles 15*a*, 15*b* and are firmly attached, e.g., screwed, to the machine frame 2. By this parallel arrangement of two connecting spindles 15*a*, 15*b* with associated first, second and third rolling-contact bearings 16*a*, 16*b*, 19*a*, 19*b*, the processing element 3 is supported on the machine element 2 in such a way as to resist tilting, i.e., lateral skewing.

The connecting spindles 15*a*, 15*b* are simultaneously driven via the reciprocating motor 17 and are set in a reciprocating movement in the longitudinal direction L.

Figure 4:
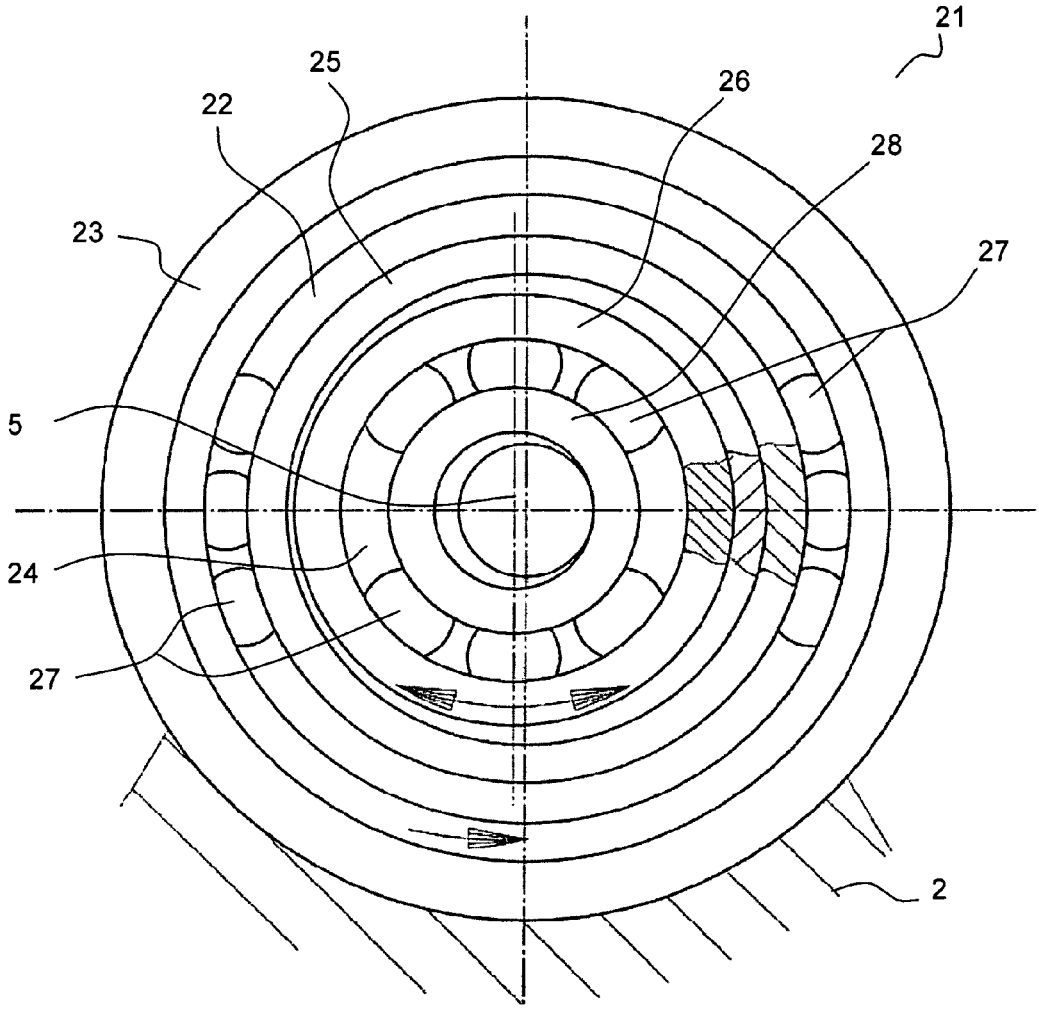
FIG. 4 is a plan view showing a floating-bearing arrangement with two linear rolling-contact bearings arranged centrally about a common axis and having a common driven connecting bearing shell according to the invention.

FIG. 4 shows another embodiment of a floating-bearing arrangement 21, in which a second rolling-contact bearing 22 in the form of a linear rolling-contact bearing is firmly attached with its outer ring 23 to a support, e.g., frame 2. A first rolling-contact bearing 24 is fitted in such a way as to be slightly offset about the bearing axis of the second rolling-contact bearing 22. The inner ring 25 of the second rolling-contact bearing 22 interacts with the outer ring 26 of the first rolling-contact bearing 24. The drive shaft 5 is in turn coupled to the inner ring 28 of the first rolling-contact bearing 24.

Rolling-contact bodies 27 are provided in a known manner in each case between the inner ring 25 and outer ring 23 of the second rolling-contact bearing 22 and between the inner ring 28 and the outer ring 26 of the first rolling-contact bearing 24.

The outer ring 26 of the first rolling-contact bearing 24 and the inner ring 25 of the second rolling-contact bearing 22 are connected to one another, and together form a connecting bearing shell for the rolling-contact bodies 27 of the first and second rolling-contact bearings 24, 22. The connecting bearing shell is driven, e.g., by a separate motor, and in this case is preferably rotated back and forth continuously in the clockwise and counterclockwise directions. One way to accomplish such motion is to rotate connecting bearing shell 25, 26 by a pivotable shaft mounted, e.g., to a pin on the inner ring 25 or outer ring 26. The pivotable shaft is connected to an eccentric shaft driven by the separate motor, to provide the rotational back and forth movement to the connecting bearing shell, as shown by the double-headed arrow in FIG. 4. This ensures that the rolling-contact bodies 27 are constantly moved and permanently lubricated. Loads at right angles to the bearing axis are compensated for in this way without the bearing arrangement 21 being destroyed during such loads.

The foregoing description of preferred embodiments of the invention has been presented for purposes of illustration and description only. It is not intended to be exhaustive or to limit the invention to the precise form disclosed, and modifications and variations are possible and/or would be apparent in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto and that the claims encompass all embodiments of the invention, including the disclosed embodiments and their equivalents.

What is claimed is:

1. A processing machine, comprising:

a machine frame;

a processing element arranged so as to be movable relative to the machine frame;

at least one drive shaft for moving the processing element relative to the machine frame; and a floating-bearing arrangement coupling the at least one drive shaft to the machine frame and the processing element, wherein the floating-bearing arrangement comprises at least two rolling-contact bearings coupled to one another and having a first rolling-contact bearing that is coupled with the drive shaft, and a second rolling-contact bearing that is arranged on the machine frame, and a common connecting bearing shell, wherein the connecting bearing shell supports rolling-contact bodies of the first and second rolling-contact bearings and wherein the bearing arrangement comprises a drive for moving the connecting bearing shell, wherein the drive shaft is rotatably mounted on a support, the first rolling-contact bearing is connected to the support and the second rolling-contact bearing is connected to the machine frame, the rolling-contact bearings being designed as linear bearings and being coupled with one another by means of a spindle that serves as the connecting bearing shell, which extends in a main expansion direction (L) of the processing element and/or of the machine frame and is reciprocally movable in the main expansion direction.

2. A processing machine according to claim 1, comprising two spindles which extend parallel to one another in the longitudinal direction (L) of the pressure element and which in each case comprise said floating contact bearings.

3. A processing machine according to claim 1, wherein the at least one drive shaft comprises an eccentric shaft.

4. A processing machine according to claim 1, further comprising a pressure element pre-stressing the support in the axial direction of the drive shaft on the machine frame.

5. A processing machine according to claim 1, further comprising at least one toothed-belt drive for driving the at least one drive shaft, and a tensioning device (S) for pre-tensioning the toothed-belt drive.

6. A processing machine comprising a sanding machine, comprising:

a machine frame;

a processing element arranged so as to be movable relative to the machine frame;

at least one drive shaft for moving the processing element relative to the machine frame;

a floating-bearing arrangement coupling the at least one drive shaft to the machine frame and the processing element, wherein the floating-bearing arrangement comprises at least two rolling-contact bearings coupled to one another and having a first rolling-contact bearing that is coupled with the drive shaft, and a second rolling-contact bearing that is arranged on the machine frame, and a common connecting bearing shell, wherein the connecting bearing shell supports rolling-contact bodies of the first and second rolling-contact bearings and wherein the bearing arrangement comprises a drive for moving the connecting bearing shell, wherein said processing element comprises an elongated pressure element for abrasive and wherein the pressure element is supported by the machine frame by means of at least two drive shafts located at a distance from one another in the longitudinal direction (L) that comprises a main expansion direction, and wherein at least one of the drive shafts is coupled with the machine frame by means of the floating-bearing arrangement; and a spring element acting in the main expansion direction (L) to couple the support with the machine frame.

* * * * *